US010344226B2

(12) United States Patent
Schmidt et al.

(10) Patent No.: US 10,344,226 B2
(45) Date of Patent: Jul. 9, 2019

(54) PROCESS FOR PREPARING OLEFIN-CONTAINING PRODUCTS BY THERMAL STEAM CRACKING

(71) Applicant: LINDE AKTIENGESELLSCHAFT, Munich (DE)

(72) Inventors: Gunther Schmidt, Deisenhofen (DE); Boris Banovsky, Wolfratshausen (DE); Stefanie Walter, Seehausen (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/440,704

(22) PCT Filed: Nov. 7, 2013

(86) PCT No.: PCT/EP2013/003358
§ 371 (c)(1),
(2) Date: May 5, 2015

(87) PCT Pub. No.: WO2014/072058
PCT Pub. Date: May 15, 2014

(65) Prior Publication Data

US 2015/0284645 A1 Oct. 8, 2015

(30) Foreign Application Priority Data

Nov. 8, 2012 (EP) ..... 12007602

(51) Int. Cl.
*C07C 4/02* (2006.01)
*C10G 69/06* (2006.01)
(Continued)

(52) U.S. Cl.
CPC ..... *C10G 69/06* (2013.01); *C10G 9/00* (2013.01); *C10G 9/36* (2013.01); *C10G 55/04* (2013.01); *C10G 2400/20* (2013.01)

(58) Field of Classification Search
CPC ..... C10G 69/06; C10G 9/00; C10G 55/04; C10G 9/36; C10G 55/08; C10G 51/023; C10G 51/06
(Continued)

(56) References Cited

U.S. PATENT DOCUMENTS 4,180,453 A * 12/1979 Franck ..... C10G 65/06 208/57
4,297,204 A * 10/1981 Schliebener ..... C10G 69/06 208/106
(Continued)

FOREIGN PATENT DOCUMENTS

DE 3504941 A1 8/1986
FR 2830537 A1 11/2003
GB 1602097 A 4/1981

*Primary Examiner* — Philip Y Louie
*Assistant Examiner* — Aaron W Pierpont
(74) *Attorney, Agent, or Firm* — Millen White Zelano & Branigan, PC

(57) ABSTRACT

A process for preparing olefinic products by thermal steam cracking of a first furnace feed composed of hydrocarbons in at least one first cracking furnace and of a second furnace feed composed of hydrocarbons in at least one second cracking furnace. The first furnace feed is at least partly converted into a first product stream in the first cracking furnace and the second furnace feed is at least partly converted into a second product stream in the second cracking furnace. A first pyrolysis oil is isolated from the first product stream and is at least partly treated chemically. The first pyrolysis oil is at least partly recirculated as furnace feed from downstream of the chemical treatment to the first cracking furnace. The first cracking furnace and the second cracking furnace are operated under different cracking conditions.

21 Claims, 2 Drawing Sheets

(51) Int. Cl.
*C10G 55/04* (2006.01)
*C10G 9/36* (2006.01)
*C10G 9/00* (2006.01)

(58) Field of Classification Search
USPC ..... 585/251, 648; 208/130
See application file for complete search history.

(56) References Cited

U.S. PATENT DOCUMENTS 4,548,706 A * 10/1985 Papadopoulos ..... C10G 9/00 208/130
4,780,196 A * 10/1988 Alagy ..... B01J 19/2425 208/106
4,906,442 A * 3/1990 Johnson ..... C10G 9/14 165/184
4,990,709 A * 2/1991 Wu ..... C10M 107/10 585/10
2006/0089518 A1* 4/2006 Bouvart ..... C10G 9/00 585/648
2006/0100473 A1* 5/2006 Grootjans ..... C10G 11/05 585/652
2006/0229482 A1* 10/2006 Setoyama ..... C07C 2/864 585/638
2007/0090018 A1 4/2007 Keusenkothen et al.
2007/0090019 A1 4/2007 Keusenkothen et al.
2007/0090020 A1 4/2007 Buchanan et al.
2007/0170093 A1* 7/2007 Jeong ..... B01J 21/12 208/110
2008/0194900 A1* 8/2008 Bhirud ..... C10G 9/00 585/648

* cited by examiner

PROCESS FOR PREPARING OLEFIN-CONTAINING PRODUCTS BY THERMAL STEAM CRACKING

The present invention relates to a process for preparing olefinic products by thermal steam cracking of a first furnace feed composed of hydrocarbons in at least one first cracking furnace and a second furnace feed composed of hydrocarbons in at least one second cracking furnace, where the first furnace feed is at least partly converted into a first product stream in the at least one first cracking furnace and the second furnace feed is at least partly converted into a second product stream in the at least one second cracking furnace and where a first pyrolysis oil is isolated from the first product stream and a second pyrolysis oil is isolated from the second product stream and the first pyrolysis oil is at least partly treated chemically.

PRIOR ART

Thermal steam cracking (also referred to as steam cracking) is a long-established petrochemical process. The classical target compound here is ethylene (ethene) which represents an important starting compound for a series of chemical syntheses. In modern processes and apparatuses for thermal steam cracking, use is increasingly being made of mild cracking conditions (see below) because, in particular, high value products, for example propylene and butadiene, can be obtained in increased yield under these conditions (as explained below). However, under mild cracking conditions, the conversion of the furnace feed used is simultaneously also decreased, so that compounds present in the furnace feed go over in a relatively large amount into the product stream and lead to dilution of the high value products. This is also particularly true of the pyrolysis oil explained below.

Thermal steam cracking enables both gases such as ethane, propane or butane and corresponding mixtures and also liquid hydrocarbons and hydrocarbon mixtures such as natural gas condensates or fractions such as naphtha originating from crude oil processing to be reacted.

For the detailed apparatuses and reaction conditions used in thermal steam cracking and the reactions which proceed and also details of the refinery technology, reference may be made to corresponding articles in reference works such as Zimmermann, H, and Walzl, R.: Ethylene. in: Ullmann's Encyclopedia of Industrial Chemistry, 6th edition, Weinheim: Wiley-VCH, 2005, and Irion, W. W. and Neuwirth, O. S.: Oil. Refining. in: Ullmann's Encyclopedia of Industrial Chemistry, 6th edition. Weinheim: Wiley-VCH, 2005. Processes for preparing olefinic products are also disclosed, for example, in U.S. Pat. Nos. 3,714,282 A and 6,743,961 B1.

Plants having one or more cracking furnaces are used for thermal steam cracking. The cracking furnaces are, together with corresponding quenching units and downstream facilities for treating the products streams obtained, integrated into larger plants which are collectively also referred to as steam crackers, olefin plants, ethylene plants, etc. Details regarding the cracking furnaces are given below.

In the present patent application, the term furnace feed or else feed is used to refer to a hydrocarbon-containing stream which is fed in liquid or gaseous form into a cracking furnace. This furnace feed is generally composed of hydrocarbon mixtures which are fed into the plant and are referred to as fresh feed (for example naphtha) and usually a plurality of further hydrocarbon streams which are recirculated from the plant. Such recirculated streams are also referred to as recycle streams. The furnace feed is at least partly reacted in the cracking furnace. Directly at the outlet of the cracking furnace, the furnace feed present there in at least partly reacted form is referred to as cracking product stream, product stream or cracking gas.

In plants for thermal steam cracking, the abovementioned recycle streams are usually recirculated to the cracking furnace. The furnace feed is usually only partly reacted in the cracking furnace. This means that not all compounds in the furnace feed react and also that the compounds in the furnace feed do not react completely or secondary reactions occur and the desired end products are not obtained. The cracking products can, optionally after treatment, be separated off and discharged as desired end product or be used as recycle streams, i.e. returned to the furnace.

An important parameter in thermal steam cracking is the cracking severity which describes the cracking conditions. The cracking conditions are influenced, in particular, by the temperature and the residence time and also the partial pressures of the hydrocarbons in the cracking furnace and of the steam used. The composition of the furnace feed and the construction type of the cracking furnace used also influence the cracking conditions. Owing to the interactive influences of these factors, the cracking conditions are normally described via the ratio of propylene (propene) to ethylene (P/E ratio) or the ratio of methane to propylene (M/P ratio) in the cracking gas or the product stream, on a weight basis (kg/kg). The smaller the ratio of propylene to ethylene or the greater the ratio of methane to propylene, the more severe are the prevailing cracking conditions, while at higher values mild cracking conditions prevail. The ratios mentioned are directly dependent on the temperature, but in contrast to the actual temperature in or at the outlet of a cracking furnace can be measured very much more accurately and used, for example, as regulating parameter in a corresponding regulating system.

Depending on the furnace feed and cracking conditions, thermal steam cracking forms not only the classical target compound ethylene but sometimes large amounts of and a multitude of by-products which likewise may be separated off and isolated appropriately. These are, inter alia, lower alkenes such as propylene, butenes and dienes, in particular butadienes, and also aromatics such as benzene, toluene and xylenes. These have a comparatively high economic value, so that their formation as high value products is desirable.

However, undesirable products such as methane, pyrolysis gasolene and pyrolysis oil are also obtained in addition to the desired products. Pyrolysis gasolene contains high value products and can be worked up in the plant and also be recirculated as feed. Pyrolysis oil, on the other hand, can conventionally only be passed on at the battery limits and has only a low value, since it is used virtually exclusively as heating means.

Processes and apparatuses for steam cracking in which individual fractions such as pyrolysis oil can also be treated and recirculated in order to pass these to a worthwhile use are known, inter alia, from DE 100 54 787 A1, DE 100 40 208 A1, DE 35 04 941 A1, WO 2006/063201 A1, U.S. Pat. No. 3,839,484 A and US 2009/272671 A1.

DE 35 04 941 A1 discloses a process for cracking a hydrocarbon feed, in which an olefin-rich stream and a pyrolysis oil are obtained as products. The pyrolysis oil is separated into a pyrolysis oil heavy fraction and a pyrolysis oil light fraction.

US 2007/0090018 A1 discloses integration of a hydrogenation process and a steam cracking process. A feed containing crude oil or a residue fraction thereof is subjected to a hydrotreatment process and fed to a steam cracker in order to obtain an olefin product.

However, there continues to be a need to improve processes of this type for thermal steam cracking. In particular, the proportion of high value products should be increased.

DISCLOSURE OF THE INVENTION

In the light of this background, the invention proposes a process for preparing olefinic products by thermal steam cracking of a first furnace feed composed of hydrocarbons in at least one first cracking furnace and a second furnace feed composed of hydrocarbons in at least one second cracking furnace, where the first furnace feed is at least partly converted into a first product stream in the at least one first cracking furnace and the second furnace feed is at least partly converted into a second product stream in the at least one second cracking furnace and where a first pyrolysis oil is isolated from the first product stream and a second pyrolysis oil is isolated from the second product stream and the first pyrolysis oil is at least partly treated chemically. Furthermore, at least one olefinic product is isolated from the first product stream and from the second product stream.

The process of the invention and further embodiments are described in the following description.

According to the invention, the process is thus characterized, inter alia, in that the first pyrolysis oil is at least partly treated chemically and then at least partly thermally steam cracked in the at least one first cracking furnace, i.e. fed as recycle stream and as at least part of the furnace feed to this at least one first cracking furnace. Furthermore, the first product stream and the second product stream are, after the first pyrolysis oil and the second pyrolysis oil have been separated off, combined to form a joint product stream and jointly treated further to isolate the at least one olefinic product.

Furthermore, at least one first cracking furnace is, according to the invention, operated under different, in particular milder, cracking conditions than the at least one second cracking furnace. As indicated below, it is particularly advantageous for the at least one first cracking furnace to be operated under mild cracking conditions and the at least one second cracking furnace to be operated under normal cracking conditions. The terms "mil" and "normal" cracking conditions will be familiar to those skilled in the art and are defined in more detail below.

ADVANTAGES OF THE INVENTION

According to the invention, at least part of the first pyrolysis oil which is separated off from the first product stream downstream of the at least one first cracking furnace is thus at least partly treated chemically and, downstream of the chemical treatment, the chemically treated part is at least partly recirculated to the at least one first cracking furnace. In the at least one first cracking furnace, this chemically treated part is at least partly reacted by thermal steam cracking.

As mentioned, the at least one first cracking furnace is, according to the invention, operated under different, in particular milder cracking conditions than the at least one second cracking furnace. A process of this type therefore allows very flexible treatment of the hydrocarbons and hydrocarbon mixtures available in appropriate processes, both of fresh feeds of the appropriate type and corresponding recycle streams, in particular of the pyrolysis oil. In particular, a cyclic process which includes the at least one first cracking furnace can be established in the context of the present invention.

As also described in detail below, this at least one first cracking furnace can be operated under mild cracking conditions which result in desired high value products being formed by corresponding steam cracking. A first pyrolysis oil which is obtained from a cracking gas stream from the at least one first cracking furnace and which contains a considerable proportion of compounds which have not been reacted in the at least one first cracking furnace can be treated chemically and at least partly fed back to the at least one first cracking furnace. The process of the invention thus makes it possible to subject a correspondingly treated first pyrolysis oil which has already been produced under mild cracking conditions once again to the mild cracking conditions so that the high value products mentioned can be formed again, for example from the compounds which have not been reacted in a previous pass through the at least one first cracking furnace or from the compounds obtained by means of the chemical treatment process. The first pyrolysis oil therefore does not necessarily have to be subjected to normal, i.e. more severe, cracking conditions in which the abovementioned high value products may no longer be formed or be formed in a smaller amount. However, part of the first pyrolysis oil can equally well be fed to the at least one second cracking furnace which is operated under normal, i.e. more severe, cracking conditions, for example for capacity reasons.

High value products can be separated off from the first and second product streams from the at least one first cracking furnace and the at least one second cracking furnace and be discharged from a corresponding plant. Since, according to the invention, at least two differently operated cracking furnaces are present (in the than of the at least one first cracking furnace and the at least one second cracking furnace), it is also possible to crack components present in the first product stream and the second product stream in any proportions under milder or more severe cracking conditions, depending on requirements.

For example, it can be advantageous to subject hydrocarbons having four carbon atoms (but, for example, without butadiene) or hydrocarbons having five and more carbon atoms (including, for example, pyrolysis gasolene) to more severe cracking conditions than the abovementioned treated first pyrolysis oil, for example because such compounds may not be reacted sufficiently under milder cracking conditions. Conversely, the second pyrolysis oil which is obtained under these more severe cracking conditions may not be suitable in the same way as the first pyrolysis oil for the chemical treatment and cracking under the mild cracking conditions because the compounds present therein can no longer be converted into the desired high value products because of the previous higher severity (normal) cracking.

If necessary, a different fresh feed can also be fed into the at least one first cracking furnace than into the at least one second cracking furnace, so that optimized cracking conditions can be used for different fresh feeds according to their respective crackability and the desired products.

Overall, the appropriate cracking severity can therefore be selected for each hydrocarbon fraction and possibly also for each fresh feed to the in each case more suitable cracking furnace in the process of the invention, so that a process of this type can be optimized overall in respect of the hydrocarbons available and the desired products. A plant in which the process of the invention has been established can, if required, also be matched to changing market conditions and the like.

Steam cracking processes are, on the commercial scale, carried out virtually exclusively in tube reactors in which the individual reaction tubes (in the form of helically coiled tubes, known as coils) or groups of corresponding reaction tubes can also be operated under different cracking conditions. Reaction tubes or groups of reaction tubes operated under identical or comparable cracking conditions, but optionally also tube reactors overall operated under uniform cracking conditions, will hereinafter each be referred to as cracking furnaces. In the language used here, a cracking furnace is thus a structural unit which is used for steam cracking and subjects a furnace feed to the same or comparable cracking conditions. A plant for steam cracking can have one or more such cracking furnaces.

The terms "plant for steam cracking", "steam cracking plant", "ethylene plant" and/or "olefin plant" are used synonymously here. Such plants comprise, in the language used here, one or more cracking furnaces which can be operated under identical or different cracking conditions and can be supplied with identical or different olefin feeds and also a "separation plant" which is equipped for separation of a cracking gas or product stream obtained and typically comprises a series of distillation columns and is equipped for separating the cracking gas into a plurality of fractions on the basis of the boiling points of the hydrocarbons present. The separation plant is, in particular, equipped for separating off the first and second pyrolysis oils and for further treatment of the first and second product streams. As also explained below, the treatment of the, first product stream and of the second product stream and the isolation of the first pyrolysis oil and of the second pyrolysis oil are effected separately from one another.

According to the invention, at least two of the abovementioned cracking furnaces (at least one first cracking furnace and one second cracking furnace) are used; apart from these, there does not have to be but can be, a further cracking furnace. Any further cracking furnaces present can be operated under identical or different cracking conditions. To be able to make a distinction, reference will be made here to a first product stream which leaves the at least one first cracking furnace and to a first pyrolysis oil which is separated off from the first product stream. Correspondingly, reference will also be made to a second product stream which leaves the at least one second cracking furnace and to a second pyrolysis oil which is separated off from the second product stream. Here too, further product streams and pyrolysis oils are not necessarily able to be produced, but may be able to be produced. According to the invention, the pyrolysis oil referred to as first pyrolysis oil is treated chemically and then at least partly subjected to thermal steam cracking in the at least one first cracking furnace.

Downstream of the at least one first cracking furnace and the at least one second cracking furnace, the first product stream and the second product stream are conveyed separately from one another, and the isolation of the first pyrolysis oil and the second pyrolysis oil is also carried out separately for the first product stream and the second product stream.

Especially when using mild cracking conditions in the thermal cracking of heavy fresh feeds, large amounts of undesirable pyrolysis oil are obtained. This is a result of the comparatively low conversion of the heavy feeds under mild cracking conditions. The nature of the pyrolysis oil from different feeds and cracking conditions is known to those skilled in the art. The pyrolysis oil obtained under mild cracking conditions from heavy fresh feeds contains a very large amount of unreacted hydrocarbon compounds. Furthermore, it contains compounds which are formed in the reactions of thermal steam cracking. In general, these are naphthenic and aromatic hydrocarbon compounds having a low hydrogen-to-carbon ratio. These compounds are unsuitable as feed to renewed steam cracking, so that the pyrolysis oil cannot be recycled directly. Owing to the comparatively high proportions of pyrolysis oil produced, the economics of the process thus deteriorate for the cracking of heavy fresh feeds under mild cracking conditions, with a simultaneous increase in the selectivity in the direction of the high value products mentioned at the outset.

Thus, mild cracking conditions are desirable on the one hand because they lead to increased formation of the high value products but on the other hand have the disadvantage of the reduced conversion of the starting compounds and the increased formation of compounds which cannot be reacted correspondingly.

In the context of the invention, it has now been recognized, in particular, that a pyrolysis oil formed in the cracking of heavy fresh feeds under mild cracking conditions has a different nature than a pyrolysis oil obtained in the cracking of conventionally used (lighter) fresh feeds under normal or mild cracking conditions or even in the cracking of heavy fresh feeds under normal cracking conditions. A pyrolysis oil which is obtained in the cracking of heavy fresh feeds under mild cracking conditions and whose nature has been described above can therefore be at least partly recirculated particularly advantageously as furnace feed after a chemical treatment. According to the invention, recirculation is effected into the at least one first cracking furnace whose preferably milder cracking conditions are particularly suitable for a reaction. As mentioned, further high value products can be obtained in a renewed mild cracking operation, which might not have been possible to the same extent in the case of a subsequent more severe cracking operation.

The process of the invention now indicates how the large amounts of pyrolysis oil. obtained in the cracking of heavy fresh feeds under mild cracking conditions can be dealt with. The invention thus proposes a process which makes it possible to operate cracking furnaces economically using heavy fresh feeds under mild cracking conditions.

Even though the advantages of the invention have been and are described with reference to the thermal steam cracking of heavy fresh feeds under mild cracking conditions, the advantages are obtained, albeit to a lesser extent, when a conventional fresh feed and/or normal cracking conditions are used. However, the pyrolysis oil may then not be of this particular nature just described but may contain a smaller amount of unreacted compounds and fewer other compounds which are suitable for chemical treatment and optionally subsequent mild cracking than a pyrolysis oil formed in the cracking of heavy fresh feeds under mild cracking conditions. The amount of pyrolysis oil then obtained may also be smaller than that in the cracking of heavy fresh feeds under mild cracking conditions. The extent to which the nature of the pyrolysis oil and the amount of pyrolysis oil are different depends on the precise composition of the fresh feed and the precise cracking conditions used.

According to the invention, as mentioned, the first pyrolysis oil is, downstream of the chemical treatment, at least partly recirculated as furnace feed to the at least one first cracking furnace. The thermal steam cracking of the recirculated, chemically treated first pyrolysis oil thus takes place at least partly in the same cracking furnace from which the first product stream from which it has been isolated originates. As a result of the recycling which is now possible after the chemical treatment, in particular in the case of mild cracking conditions, the pyrolysis oil can be virtually completely reacted and largely converted into high value products. Recirculation to the at least one first cracking furnace and the at least one second cracking furnace is also conceivable, which is intended to be covered by the formulation that the first pyrolysis oil is, downstream of the treatment, "at least partly" recirculated as furnace feed to the at least one first cracking furnace.

The invention provides for a heavy fresh feed comprising predominantly hydrocarbons having boiling points above 180° C. to be fed into the first cracking furnace. In particular, the boiling points are in the range from 180° C. to 600° C. If the fresh feed comprises predominantly hydrocarbons having boiling points above 180° C., this is a heavy fresh feed. Within this overall range, it is also possible to use hydrocarbon mixtures having different boiling ranges, for example boiling ranges from 180 to 360° C. or from 240 to 360° C. or from 180 to 240° C. or boiling ranges above 360° C.

In particular, mixtures of hydrocarbons obtained in crude oil processing are used as fresh feed. Thus, the heavy or high-boiling hydrocarbon mixtures in the form of middle distillates, for example kerosene or diesel, atmospheric gas oils, vacuum gas oils and/or mixtures derived therefrom from crude oil processing are particularly suitable. Crude oil fractions which have been subjected to a hydrogenation step, for example hydrocracker residue, hydrogenated vacuum gas oil or unconverted oil from a hydrocracker, are also suitable. However, it is also possible to use any other hydrocarbon mixtures which have comparable properties, e.g. biogenic or synthetic hydrocarbon mixtures.

Middle distillates are light and heavy gas oils which can be used as starting materials for producing light heating oils and diesel oils and also heavy heating oil. The compounds present have boiling points of from 180 to 360° C. They are preferably predominantly saturated compounds which can be reacted by thermal steam cracking. Hydrocarbon fractions having a boiling point above 360° C. are usually not obtained by atmospheric distillation because decomposition can occur at these temperatures. They are referred to as atmospheric residues and can be treated further by vacuum distillation. The invention encompasses the use of fractions obtained directly by known distillative separation processes and the corresponding residues and also the use of fractions derived therefrom, for example by hydrogenation processes.

Examples of heavy hydrocarbon mixtures are, inter alia kerosene diesel, light as oil, heavy gas oil and vacuum gas oil (for example Atmospheric Gas Oil, AGO, and Vacuum Gas Oil, VGO) and also corresponding mixtures treated by the hydrogenation processes mentioned and/or residues from a hydrogenation unit (also referred to as hydrotreater, for example Hydrotreated Vacuum Gas Oil, HVGO, Hydrocracker Residue, HCR, or Unconverted Oil, UCO).

Advantageously, the chemical treatment of the hydrocarbons of the first pyrolysis oil increases the hydrogen-to-carbon ratio in at least part of the hydrocarbons; downstream, the part of the first pyrolysis oil in which the hydrogen-to-carbon ratio has previously been increased is at least partly recirculated as furnace feed. The preferred objective of the chemical treatment is thus to shift the hydrogen-to-carbon ratio in the first pyrolysis oil or at least in part of the first pyrolysis oil to higher values. The proportion of the first pyrolysis oil which after the chemical treatment has a higher hydrogen-to-carbon ratio than before the chemical treatment is then conveyed as recycle stream to the at least one first cracking furnace. It is suitable, in particular, for mild cracking.

This increase in the hydrogen-to-carbon ratio can be effected by increasing the number of hydrogens or by reducing the number of carbons in the hydrocarbons which form the first pyrolysis oil. The former occurs in hydrogenation processes, and the latter by means of processes which make it possible to produce and separate off fractions which contain carbon and hydrocarbons which relative to hydrogen have a very great number of carbons (i.e. a low hydrogen-to-carbon ratio). An example of the latter is the coker process. The two possibilities can also be combined. The specific processes for the separation and the treatment are known to those skilled in the art and are conventionally used in refineries.

In a particularly advantageous embodiment of the invention, a hydrogenation process is used as chemical treatment process. After going through the hydrogenation process, at least some of the compounds which are present in the first pyrolysis oil fraction and have been correspondingly hydrogenated are suitable for thermal steam cracking, in particular under mild cracking conditions. Hydrogenation processes are processes in which hydrogen is added. A shift in the hydrogen-to-carbon ratio to higher values is effected by reaction of the hydrocarbons with hydrogen, generally in the presence of a catalyst. In addition, the hydrogen-to-carbon ratio in the first pyrolysis oil or in the previously at least partly treated first pyrolysis oil can be improved by separating off fractions having unfavorable hydrogen-to-carbon ratios. Hydrogenation processes include, for example, hydrotreating processes, aromatics hydrogenation processes and also hydrocracking processes. The hydrogenation processes are well-known from refineries and olefin plants.

As an alternative or in addition, processes without addition of hydrogen are also possible. In these processes, the hydrogen-to-carbon ratio is shifted within the hydrocarbons used (here: within the first pyrolysis oil or within part of the first pyrolysis oil). This results in hydrocarbon streams having lower and higher hydrogen-to-carbon ratios. Such processes are well-known from refinery technology. After the hydrocarbons having high hydrogen-to-carbon ratios have been separated off, these can be recirculated to the at least one first cracking furnace. In particular, coker, residue fluid catalytic cracking and/or aromatic saturation processes can be used for this purpose. These processes are known from the field of refinery technology and are routine there.

Particular advantages are obtained when the chemical treatment of the first pyrolysis oil is carried out in a refinery. Thus, the ethylene plant is advantageously connected to appropriate processing units of a refinery. This connection gives significant economic synergy effects because the degree of integration of corresponding plants is increased and the products can in each case be alternatively used as feed mixtures in the corresponding plants. Joint utilization of processing units thus also keeps the capital costs within the normal range. However, the units required for the chemical treatment do not necessarily have to be units of a refinery but can also be located and operated within an ethylene plant.

As pyrolysis oil, i.e. the second and first pyrolysis oils mentioned, a hydrocarbon mixture comprising predominantly compounds having a boiling point of more than 200° C. is usually separated off in ethylene plants.

The selectivity in the direction of the abovementioned high value products and propylene is significantly increased and the formation of methane is at the same time decreased when the thermal steam cracking is carried out under mild cracking conditions. Mild cracking conditions prevail when a propylene-to-ethylene ratio of more than 0.7 kg/kg is achieved at the outlet of the cracking furnace.

According to the invention, cracking conditions which lead to a propylene-to-ethylene ratio of from 0.7 to 1.6 kg/kg, preferably from 0.8 to 1.4 kg/kg, particularly preferably from 0.85 to 1.2 kg/kg, prevail in the at least one first cracking furnace into which the first furnace feed is fed and in which this feed is at least partly reacted. Such cracking conditions are referred to as mild cracking conditions in the present patent application. Mild cracking conditions also prevail, for example, at a propylene-to-ethylene ratio of from 0.7 to 0.8 kg/kg, from 0.8 to 0.9 kg/kg, from 0.9 to 1.0 kg/kg, from 1.0 to 1.1 kg/kg, from 1.1 to 1.2 kg/kg, from 1.2 to 1.3 kg/kg or from 1.3 to 1.4 kg/kg. In this case, the abovementioned advantages of the invention are particularly pronounced. The cracking conditions are influenced, in particular, by the temperature and the residence time and also the partial pressures of the hydrocarbons and of the steam. The composition of the hydrocarbon mixtures used as feed and the construction time of the cracking furnaces used also influence the cracking conditions. Owing to the interacting influences of these factors, the cracking conditions are usually laid down in the case of liquid feeds by the ratio of propylene to ethylene in the cracking gas or product stream.

As mentioned, a cracking furnace is, for the purposes of the present invention, a cracking unit in which the cracking conditions are laid down. It is possible for an overall furnace to be divided into two or more cracking furnaces. These are then frequently referred to as furnace cells. A plurality of furnace cells belonging to an overall furnace generally have independent radiation zones and a joint convection zone and joint smoke extraction, in these cases, each furnace cell can be operated under its own cracking conditions. Each furnace cell is thus a cracking unit and will consequently be referred to here as cracking furnace. The overall furnace then has a plurality of cracking units or, expressed in other words, it has a plurality of cracking furnaces. If only one furnace cell is present, this is the cracking unit and thus the cracking furnace. Cracking furnaces can be collected together into groups which are, for example, supplied with the same feed. The cracking conditions of the cracking furnaces within a furnace group are generally set so as to be identical or similar.

As indicated at the outset, the propylene-to-ethylene ratio in thermal steam cracking results from a series of different influencing factors among which the cracking furnace outlet temperature, i.e. the temperature when leaving the reactor coil used (known as the coil outlet temperature), plays an important role. The cracking furnace outlet temperature is, for the at least partial conversion of the furnace feed under the mild cracking conditions indicated, advantageously in the range from 680 to 820° C., preferably from 700 to 800° C. and more preferably from 710 to 780° C., particularly preferably from 720 to 760° C.

In the at least one first cracking furnace, it is also possible to use a comparatively low steam dilution. This reduces the necessary amount of dilution steam and saves energy. However, a low steam dilution is not absolutely necessary to attain the significant advantages of the invention, It is advantageous to use from 0.15 to 0.8 kg of steam per kg of hydrocarbon in the furnace feed.

Since, according to the invention, a plurality of cracking furnaces (or else furnace cells) in a plant are operated under different conditions, it has to be ensured that the cracking gases which are obtained in the thermal steam cracking under mild conditions and/or from heavy fresh feeds (i.e. the first product stream) are conveyed into a dedicated treatment unit in which, inter alia, the separation of the first pyrolysis oil from the product stream occurs. The cracking gases which are obtained, for example, in thermal steam cracking under normal cracking conditions or/and from conventional fresh feeds (such as, for example, naphtha) (for example a second product stream from one or more second cracking furnaces) are likewise conveyed into a dedicated (second) treatment unit in which, inter alia, the second pyrolysis oil is separated off from the second product stream. The first and second pyrolysis oils, which differ in their nature, can in this way be kept separate. This is advantageous since it is advisable for only the first pyrolysis oil which originates from cracking of heavy fresh feed or/and cracking under mild cracking conditions to be fed to a chemical treatment and then, in particular, to a mild cracking operation. This might be uneconomical for the second pyrolysis oil. Downstream, the first and second product streams which have been freed of the respective pyrolysis oil can then be combined and treated further in a joint treatment unit.

Thus, for example, if first cracking furnaces are operated under mild cracking conditions using heavy fresh feed and second cracking furnaces are operated under normal (or else mild) cracking conditions using naphtha as fresh feed (or else a different fresh feed or, for example, also a heavy fresh feed) in an ethylene plant, the first and second product streams of the differently operated cracking furnaces should be combined only after the first and second pyrolysis oils have been separated off in order to obtain the advantages of the invention in a particularly pronounced manner. Consequently, two oil columns (a first oil column and a second oil column) are advantageous and useful for economical operation in such an ethylene plant. For the present purposes, an "oil column" is a separation unit by means of which the pyrolysis oil can be separated off in each case from the product streams upstream of a substantial further fractionation of the product streams. The actual fractionation into the product fractions, for example the isolation of ethylene, etc., can therefore be carried out after the pyrolysis oil has been separated off and the remaining proportions of the product streams have been combined. An oil column is, for example, configured as a distillation column and separates the pyrolysis oil from further components of the product streams on the basis of its high boiling point.

Downstream, after the first and second pyrolysis oils have been separated off, the first and second product streams are, as mentioned above, combined so that the subsequent processes occur jointly and the subsequent plant units are needed only once. The first pyrolysis oil which has been separated off from the first product stream from the first cracking furnace (or the first cracking furnaces) under mild cracking conditions is in this case recirculated according to the invention to the first cracking furnace (or the first cracking furnaces) having preferably mild cracking conditions. For example, first cracking furnaces can be operated under mild cracking conditions using heavy fresh feed and second cracking furnaces can be operated under normal cracking conditions likewise using heavy fresh feed. The first pyrolysis oil which has been separated off from the first product stream from the first cracking furnace (or the first cracking furnaces) under mild cracking conditions is in this case advantageously recirculated to the first cracking furnace (or the first cracking furnaces) having mild cracking conditions.

Thus, at least two different pyrolysis oils are advantageously obtained when operating two or more cracking furnaces under different cracking conditions and/or with different furnace feeds. The product streams which have been freed of the pyrolysis oils are then advantageously combined and treated further jointly. The ethylene plant therefore preferably has two oil columns. After the pyrolysis oils have been separated off, combining the streams is advantageous since the treatment steps carried out downstream can be carried out jointly, which keeps the capital costs within normal limits.

In an advantageous embodiment of the invention in which, as mentioned, a second furnace feed is converted in at least one second cracking furnace into a second product stream by thermal steam cracking, with a second pyrolysis oil being separated off from the second product stream, this is not treated chemically. In this advantageous embodiment of the invention, cracking conditions prevail in the at least one second cracking furnace and/or a second fresh feed is fed into the at least one second cracking furnace so that the second pyrolysis oil separated off from the second product stream has such a nature that it is unsuitable or only very poorly suitable for recirculation, even after a chemical treatment. The second pyrolysis oil is therefore discharged from the ethylene plant in the process of the invention.

According to the invention, as mentioned a number of times, the first pyrolysis oil is at least partly recirculated as furnace feed to the at least one first cracking furnace. However, it is also advantageous for the first pyrolysis oil to be partly (namely in the proportion in which it is not recirculated to the first cracking furnace) recirculated to the second cracking furnace. More details and also examples for this may be found further above in the text.

In an advantageous embodiment of the invention, the at least one second cracking furnace is operated under cracking conditions which lead to a propylene-to-ethylene ratio in the further product stream at the outlet from the further cracking furnace of from 0.3 kg/kg to 1.6 kg/kg, preferably from 0.35 to 1.5 kg/kg. In particular, the second cracking furnace is operated under cracking conditions which lead to a propylene-to-ethylene ratio of from 0.3 kg/kg to 0.75 kg/kg, preferably from 0.35 to 0.6 kg/kg, which are generally referred to as normal cracking conditions. If at least one cracking furnace operated under normal cracking conditions is present in the ethylene plant, the recycling streams which are better suited for normal cracking conditions can advantageously be fed to this.

In a particularly advantageous embodiment of the invention, naphtha and/or natural gas condensates are fed as fresh feed into this at least one second cracking furnace. However, it is in principle possible to feed any desired fresh feed into this second cracking furnace. In addition to naphtha and natural gas condensates, heavy fresh feeds as have already been described in detail above and also, for example, LPG or other fresh feeds are also suitable. It has already been indicated above which fresh feed is cracked under which cracking conditions in the second cracking furnace for it to be advantageous to combine the product streams only downstream of the isolation of the first and second pyrolysis oils.

In addition, it is advantageous to feed recycle streams into this second cracking furnace. For this purpose, the high value products ethylene and propylene are advantageously isolated from the combined product stream obtained from the first and second product streams and a fraction comprising hydrocarbons having four carbon atoms and also pyrolysis gasolene are separated off. From this, high value products (for example butadiene and aromatics) are likewise isolated. The remaining fractions are advantageously fed as recycle streams to the second cracking furnace as feed. Thus, the residue from the treatment of the fraction composed of hydrocarbons having four carbon atoms and the residue from the treatment of the pyrolysis gasolene are advantageously fed as feed into the second cracking furnace.

In another advantageous embodiment of the invention, the feed to the at least one second cracking furnace consists exclusively of recycle streams. Thus, the residue from the treatment of the fraction composed of hydrocarbons having four carbon atoms and the residue from the treatment of the pyrolysis gasolene are advantageously fed as feed to the at least one second cracking furnace. In this case, no fresh feed is fed into the second cracking furnace.

BRIEF DESCRIPTION OF THE DRAWING

The process of the invention in a particularly advantageous embodiment is illustrated with the aid of the process diagrams which schematically show the essential process steps of processes according to the invention and processes which are not according to the invention.

For this purpose.

Figure 1:
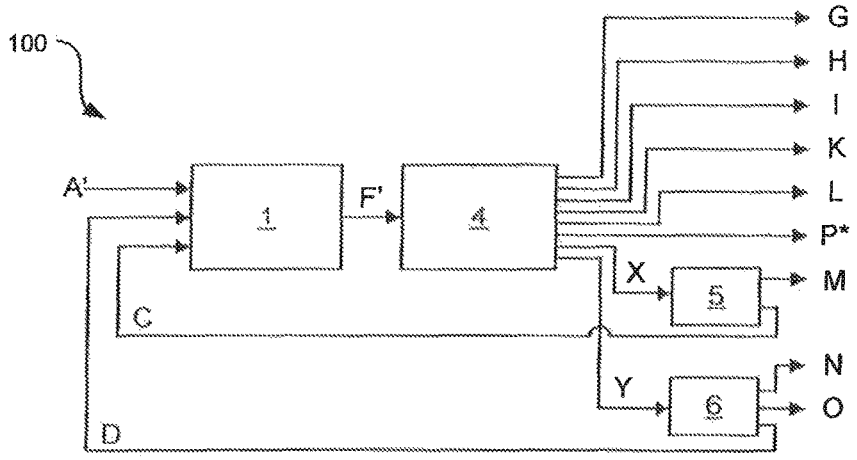
Fig. 1 (Prior Art)
FIG. 1 schematically shows a known procedure for preparing olefinic products.

The schematic process diagram 100 of FIG. 1 for the known process comprises a cracking furnace 1 into which a fresh feed A' (for example naphtha or a heavy fresh feed) and the recycle streams C and D are fed as furnace feed. In the cracking furnace 1, the furnace feed is heated in a convection zone and a radiation zone and at least partly reacted. Steam is introduced into the cracking furnace 1.

A product stream F' leaves the cracking furnace 1; directly at the outlet from the cracking furnace 1, this is also refereed to as cracking gas stream. At the outlet from the cracking furnace 1, the cracking gas stream has a temperature which is, for example, in the range from 840 to 900° C. The propylene/ethylene ratio under normal cracking conditions is generally from 0.35 to 0.6 kg/kg.

After a first quench (not shown), the product stream F' is treated in a processing unit 4. From the processing unit 4, the following fractions are obtained as significant products or product fractions G to O: hydrogen CF, waste liquor H, methane I, ethylene K, propylene L, hydrocarbons X having four carbon atoms and also pyrolysis gasolene Y. Furthermore, pyrolysis oil P* is also obtained here.

The gaseous hydrocarbons X having four carbon atoms are treated further in a C4 processing unit 5 which is used for processing hydrocarbons having four carbon atoms. Such a C4 processing unit 5 treats the fraction having four carbon atoms further in such a way that butadienes M can be discharged. The other hydrocarbons having four carbon atoms form a recycle stream C which is recirculated to the cracking furnace 2.

The pyrolysis gasolene Y, which comprises hydrocarbons having five and more carbon atoms, is processed further in a pyrolysis gasolene processing unit 6 and aromatics N and hydrocarbons O having, for example, more than nine carbon atoms are discharged. The remaining hydrocarbons having five and more carbon atoms are recirculated as recycle stream D into the cracking furnace 1.

The processing unit 4 and also the C4 processing unit 5 and the pyrolysis gasolene processing unit 6 comprise conventional units for further processing of the product stream F' or of the products or product fractions which are employed for carrying out various process steps, for example compression, condensation and cooling, drying, distillation and fractionation, extraction and hydrogenation. The process steps in olefin plants are conventional and known to those skilled in the art.

Figure 2:
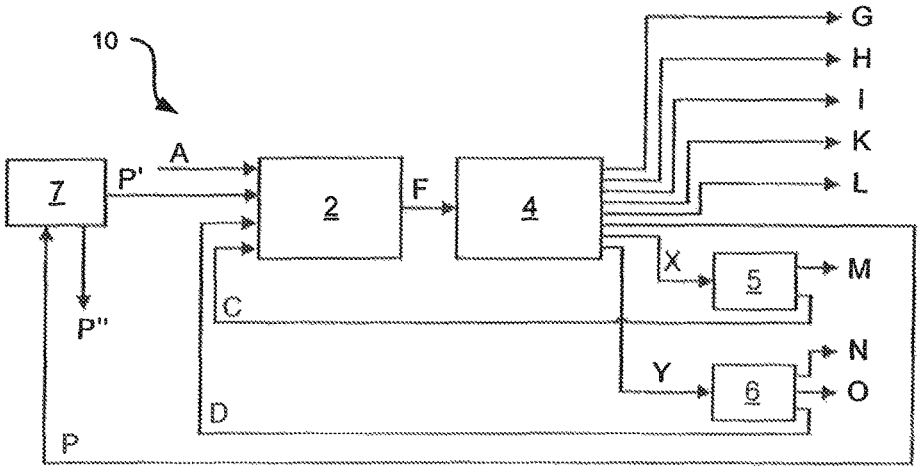
FIG. 2 schematically shows the essential steps of a further process.

The schematic process diagram 10 of FIG. 2 shows a further process and its essential process steps. Here, to demonstrate the differences from a process according to the invention, which is illustrated in particularly advantageous embodiments in FIGS. 3 and 4, the terms "first" fresh feed, "first" cracking furnace, "first" product stream and "first" pyrolysis oil are used, even though there is no "second" fresh feed, "second" cracking furnace, "second" product stream and "second" pyrolysis oil in the process shown in FIG. 2.

Here, a first fresh feed A is fed to a first cracking furnace 2. This is, in particular, a heavy hydrocarbon mixture. A first product stream, here designated by F, leaves the first cracking furnace 2. The first product stream F has a temperature which is advantageously in the range from 700 to 800° C. The propylene/ethylene ratio is advantageously in the range from 0.7 to 1.5 kg/kg. Thus, a heavy fresh feed is cracked under mild cracking conditions in the first cracking furnace 2. The first product stream F is in turn processed further in a processing unit 4, as indicated above. Thus, the processing unit 4 also leads, as just described, to the product fractions G to O. The product fractions X and Y, too, are treated further as just described in the specific processing units 5 and 6 where, as described above, the butadienes M and the aromatics N and also the hydrocarbons having more than nine carbon atoms are isolated and discharged, while the remaining hydrocarbons having four carbon atoms form the recycle stream C and the remaining hydrocarbons having five and more carbon atoms form the recycle stream D, The recycle streams C and D are recirculated to the cracking furnace 2.

However, in contrast to the process described in FIG. 1, the pyrolysis oil P (here referred to as "first" pyrolysis oil) is now not discharged. The first pyrolysis oil P is treated chemically and at least partly recirculated to the first cracking furnace 2. For this purpose, the first pyrolysis oil P is fed to a pyrolysis oil processing unit 7 and the treated proportion P' is recirculated to the first cracking furnace 2 while the proportion P" is discarded. As indicated, the pyrolysis oil processing unit 7 can be, for example, a hydrogenation unit of a refinery plant (not shown).

Figure 3:
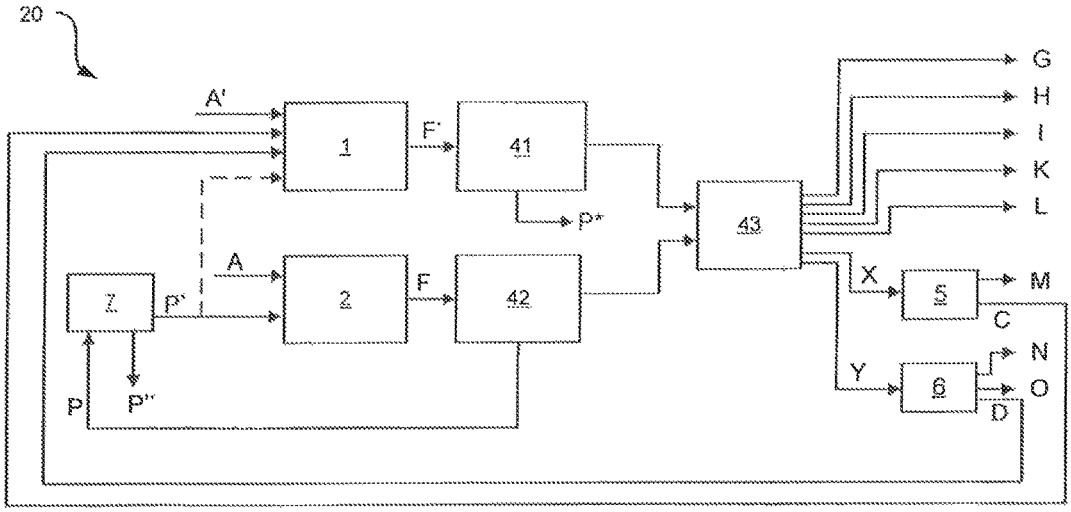
FIG. 3 and FIG. 4 schematically show the essential steps of a particularly advantageous embodiment of the invention.
Figure 4:
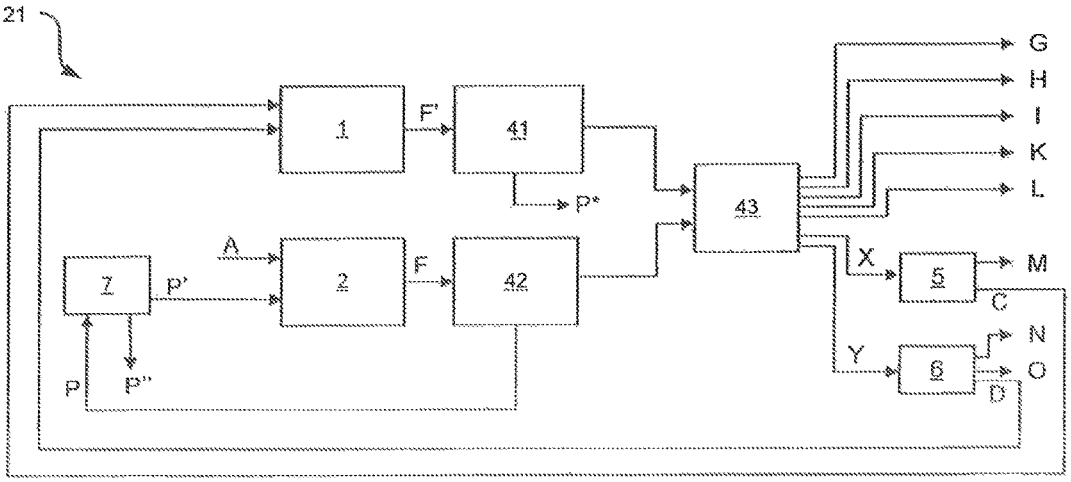

The schematic process diagrams 20 and 21 of FIGS. 3 and 4 show the process of the invention in particularly advantageous embodiments with the essential process steps. For this purpose, FIG. 3 shows identical and similar process steps as FIG. 2. Additions and modifications are described below.

In addition to the first cracking furnace 2, a second cracking furnace 1 is present. In the second cracking furnace 1, thermal steam cracking of a second fresh feed A' takes place. However, the product streams F and F' are kept separate after leaving the first cracking furnace 2 and the second cracking furnace 1 and are in each case fed to a partial processing unit 42 or 41. There, the first treatment steps take place. In the partial processing unit 41, the second pyrolysis oil P* is separated off from the second product stream F' which comes from the second cracking furnace 1. In the partial processing unit 42, the first pyrolysis oil P is separated off from the first product stream F which comes from the first cracking furnace 2. The partial processing units 41 and 42 are preferably oil columns. After the first and second pyrolysis oils P* and P have been separated off, the product streams are combined and treated further in the processing unit 43 in such a way that the abovementioned products can be discharged. While the second pyrolysis oil P* is discharged, the first pyrolysis oil P is treated chemically, for which purpose it is fed to the pyrolysis oil processing unit 7 and the chemically treated part P' is recirculated both into the second cracking furnace 1 and into the first cracking furnace 2, while the part P" obtained in the chemical treatment is discarded and discharged. According to the invention, the chemically treated part P' is thus at least partly recirculated to the first cracking furnace 2. A further part (shown as a broken line) can also be conveyed into the second cracking furnace 1. The recycle streams C and D, on the other hand, are advantageously recirculated to the second cracking furnace 1.

In addition, a further cracking furnace (not shown) for gaseous feed, into which saturated gas hydrocarbons which have two or three carbon atoms and are obtained in the processing unit 4 or 43 can be fed, can be provided in a particularly advantageous embodiment of the invention. At this point, it should be emphasized once again that the cracking furnaces shown in the process diagrams may also be present a number of times in the ethylene plant.

FIG. 4 shows a further, particularly preferred embodiment of the invention. In contrast to the embodiment described in FIG. 3, the fresh feed A is fed only to the first cracking furnace 2. In the example depicted, no fresh feed is fed into the second cracking furnace 1. It is equally possible for a corresponding fresh feed A', as shown above in FIG. 3, also to be fed to the second cracking furnace 1. The recycle streams C and D are fed into the second cracking furnace 1. The chemically treated part P' of the first pyrolysis oil can, as indicated above in respect of FIG. 3, be recirculated according to the invention into the first cracking furnace 2 or both into the second cracking furnace 1 and into the first cracking furnace 2. FIG. 4 merely shows recirculation into the first cracking furnace 2. According to the invention, recirculation here too is thus effected at least partly into the first cracking furnace 2. The remainder of the process is carried out in the same way as the process shown in FIG. 3.

LIST OF REFERENCE SYMBOLS

1 Second cracking furnace (preferably normal cracking conditions)

2 First cracking furnace (preferably mild cracking conditions)

4, 43 Processing units

42, 42 Partial processing units (preferably oil columns)

5 C4 processing unit

6 Pyrolysis gasolene processing unit

7 Pyrolysis oil processing unit

100 Schematic process diagram for a known process

10 Schematic process diagram for a further process

20, 21 Schematic process diagrams for particularly preferred embodiments of the process of the invention A, A' Fresh feeds C, D Recycle streams F, F' Cracking gas streams G-O Products P, P* Pyrolysis oils P', P' Pyrolysis oil fractions after chemical treatment X, Y Product fractions

The invention claimed is:

1. A process for preparing olefinic products by thermal steam cracking comprising:

thermally steam cracking a first furnace feed comprising a heavy fresh feed containing predominantly hydrocarbons having boiling points above 180° C. in at least one first cracking furnace under first cracking conditions to convert at least part of the first furnace feed into a first product stream, wherein the first product stream at the outlet of the at least one first cracking furnace has a propylene-to-ethylene ratio of from 0.85 to 1.6 kg/kg;

thermally steam cracking a second furnace feed composed of hydrocarbons in at least one second cracking furnace under second cracking conditions to convert at least part of the second furnace feed into a second product stream, wherein the first cracking conditions in said at least one first cracking furnace are different than the second cracking conditions in said at least one second cracking furnace;

isolating a first pyrolysis oil comprising hydrocarbons from the first product stream to produce a first product stream without said first pyrolysis oil and isolating a second pyrolysis oil from the second product stream to produce a second product stream without said second pyrolysis oil;

subjecting at least part of the first pyrolysis oil to a chemical treatment to produce an at least partly chemically treated first pyrolysis oil, wherein said chemical treatment comprises increasing the hydrogen-to-carbon ratio of at least part of the hydrocarbons of the first pyrolysis oil;

recirculating at least part of the at least partly chemically treated first pyrolysis oil as furnace feed to the at least one first cracking furnace;

combining the first product stream without said first pyrolysis oil with the second product stream without said second pyrolysis oil to form a joint product stream; and further treating said joint product stream to produce at least one olefinic product, wherein said further treating comprises separating said olefinic product from said joint product stream.

2. The process as claimed in claim 1, wherein said second pyrolysis oil is not subjected to a chemical treatment.

3. The process as claimed in claim 1, wherein recirculating at least part of the least partly chemically treated first pyrolysis oil as furnace feed to the at least one first cracking furnace comprises:

(i) recirculating a first portion of the at least part of the at least partly chemically treated first pyrolysis oil as furnace feed to the at least one first cracking furnace; and (ii) recirculating a second portion of the at least part of the at least partly chemically treated first pyrolysis oil as furnace feed to the at least one second cracking furnace.

4. The process as claimed in claim 1, wherein said heavy fresh feed is kerosene, diesel, an atmospheric gas oil or a vacuum gas oil.

5. The process as claimed in claim 1, wherein said recirculating of at least part of the at least partly chemically treated first pyrolysis oil as furnace feed to the at least one first cracking furnace comprises recirculating at least part of the at least part of the hydrocarbons of the first pyrolysis oil in which the hydrogen-to-carbon ratio has been increased to the at least one first cracking furnace.

6. The process as claimed in claim 5, wherein said chemical treatment is a hydrogenation process.

7. The process as claimed in claim 1, wherein said chemical treatment of at least part of the first pyrolysis oil is carried out in a refinery.

8. The process as claimed in claim 1, wherein the first product stream at the outlet of the at least one first cracking furnace has a propylene-to-ethylene ratio of from 0.85 kg/kg to 1.4 kg/kg.

9. The process as claimed in claim 1, wherein said first product stream at the outlet of the at least one first cracking furnace has a temperature in the range from 680° C. to 820° C.

10. The process as claimed in claim 1, wherein a first oil column is used for isolating the first pyrolysis oil from the first product stream and a second oil column is used for isolating the second pyrolysis oil from the second product stream.

11. The process as claimed in claim 1, wherein the second product stream at the outlet of the at least one second cracking furnace has a propylene-to-ethylene ratio of from 0.3 kg/kg to 1.6 kg/kg.

12. The process as claimed in claim 1, further comprising isolating a butadiene-free fraction of hydrocarbons having four carbon atoms and an aromatics-free pyrolysis gasoline fraction from either said first product stream or said second product stream, and recirculating said butadiene-free fraction and said aromatics-free pyrolysis gasoline fraction as feed to said at least one second cracking furnace.

13. The process as claimed in claim 6, wherein said hydrogenation process is a hydrotreatment process, a hydrocracking process or an aromatics hydrogenation process.

14. The process as claimed in claim 5, wherein said chemical treatment is performed without introduction of hydrogen.

15. The process as claimed in claim 1, wherein the first product stream at the outlet of the at least one first cracking furnace has a propylene-to-ethylene ratio of from 0.85 kg/kg to 1.5 kg/kg.

16. The process as claimed in claim 11, wherein the second product stream at the outlet of the at least one second cracking furnace has a propylene-to-ethylene ratio of from 0.35 kg/kg to 1.5 kg/kg.

17. The process as claimed in claim 14, wherein said chemical treatment is a coking process, a residue fluid catalytic cracking process, or an aromatics saturation process.

18. The process as claimed in claim 1, wherein said further treating of said joint product stream to produce at least one olefinic product comprises isolating a butadiene-free fraction of hydrocarbons having four carbon atoms and an aromatics-free pyrolysis gasoline fraction from said joint product stream, and further comprises recirculating said butadiene-free fraction and said aromatics-free pyrolysis gasoline fraction as feed to said at least one second cracking furnace.

19. The process as claimed in claim 1, wherein the first product stream at the outlet of the at least one first cracking furnace has a propylene-to-ethylene ratio of from 0.85 kg/kg to 1.2 kg/kg.

20. The process as claimed in claim 11, wherein the second product stream at the outlet of the at least one second cracking furnace has a propylene-to-ethylene ratio of from 0.3 kg/kg to 0.75 kg/kg.

21. The process as claimed in claim 1, wherein said heavy fresh feed predominantly contains hydrocarbons having boiling points from 240° C. to 360° C.

* * * * *